United States Patent [19]

Buzzichelli et al.

[11] Patent Number: 4,491,227

[45] Date of Patent: Jan. 1, 1985

[54] HOISTING ASSEMBLIES WITH A BOOM AND A COUNTERWEIGHT SUPPORT HAVING ADJUSTABLE RESPECTIVE POSITIONS

[75] Inventors: Lilian Buzzichelli, Toulouse; Kléber Roy, 26 Rue des Magnanarelles, 31500 Toulouse, both of France

[73] Assignee: Entreprises Buzzichelli, L'Union, France; by said Kléber Roy

[21] Appl. No.: 507,933

[22] Filed: Jun. 23, 1983

Related U.S. Application Data

[63] Continuation of Ser. No. 280,316, Jul. 6, 1981, abandoned.

[30] Foreign Application Priority Data

Jul. 4, 1980 [FR] France ..... 80 14990

[51] Int. Cl.[3] ..... B66C 23/72

[52] U.S. Cl. ..... 212/196

[58] Field of Search ..... 212/19, 195–198, 212/211, 262

[56] References Cited

U.S. PATENT DOCUMENTS 1,344,659 6/1920 Sjoberg ..... 212/196

2,846,081 8/1958 Moore ..... 212/211

3,433,459 3/1969 Logan ..... 212/262

4,155,463 5/1979 Buzzichelli et al. ..... 212/196

FOREIGN PATENT DOCUMENTS 596613 8/1959 Italy ..... 212/195

*Primary Examiner*—Sherman D. Basinger

*Assistant Examiner*—Stephen P. Avila

*Attorney, Agent, or Firm*—Cushman, Darby & Cushman

[57] ABSTRACT

The hoisting assembly comprises a boom, a counterweight support extending in a direction opposite to the boom in the same vertical plane as the boom, and interconnecting device therebetween for selectively adjusting the angular relationship between the boom and the counterweight support, said different elements forming a pendular assembly idly swinging about a horizontal swing shaft to assume a steady, balanced position. The boom is further hingedly connected at a hinge point remote from the swing axis to an intermediary structure pivotingly connected to said swing axis and further connected to the counterweight support by adjustable connecting member. A second adjustable connecting member interconnects the boom and the support of the pendular assembly to selectively vary the span of the boom.

3 Claims, 4 Drawing Figures

HOISTING ASSEMBLIES WITH A BOOM AND A COUNTERWEIGHT SUPPORT HAVING ADJUSTABLE RESPECTIVE POSITIONS

This is a continuation, of application Ser. No. 280,316, filed July 6, 1981, now abandoned.

BACKGROUND OF THE INVENTION

1. Field of the Invention

The present invention concerns improvements to the hoisting assemblies including means for varying the relative angular position between the boom and the counterweight support.

2. Description of the Prior Art

U.S. Pat. No. 4,155,463 (the content of which is supposed incorporated here for reference) discloses a hoisting assembly designed in order to prevent a torque reaction on the assembly main support and comprising a boom and a counterweight support extending in an opposite direction with respect to the main support and interconnected by controllably adjustable connecting means adapted to selectively modify the relative angular position between the boom and the counterweight support, said boom and said counterweight support, together with the connecting means, forming a pendular assembly idly swinging around an horizontal swing axis on said main support so as to take a balanced position whatever the load carried by the boom is.

OBJECT OF THE INVENTION

There is an object of the present invention to provide an improved hoisting assembly of the considered class exhibiting a greater versatility in operation and useful either for wide-span cranes or heavy load cranes, or for smaller hoisting and handling assemblies in workshops or warehouses.

SUMMARY OF THE INVENTION

In order to meet this object and others, there is provided a hoisting assembly of the considered class wherein the boom is hingedly connected to an intermediary pivoting structure which is in turn hingely connected to the counterweight support.

According to a feature of the invention, the boom is hingedly connected to the horizontal swing or pivot axis of the main support and to the intermediary pivoting structure at another hinge point, remote from said horizontal swing axis, so as to realize an improved triangulated trussed structure permitting a wide range of adjusting possibilities of the general configuration in operation of the hoisting assembly.

Other objects and advantages will appear from the ensuing description and drawings in which:

DETAILED DESCRIPTION OF THE DRAWINGS

Figure 1:
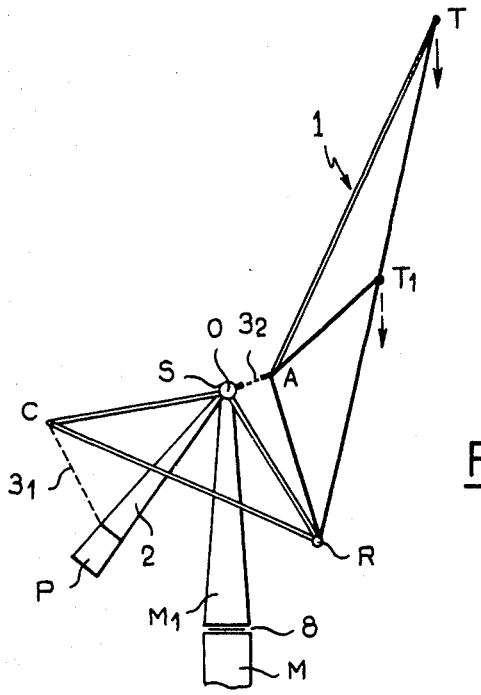
FIG. 1 illustrates a wide-span heay load hoisting assembly of the crane type according to the invention.

Referring to FIG. 1, a hoisting assembly according to the invention comprises a boom 1 comprised by the trussed structure ATR which is hingedly supported at its lower inner end R on an intermediary pivoting structure comprised by the trussed structure OCR which is adapted to pivot, in the same vertical plane as the boom 1, about the common general swing axis O of the assembly, about which the support 2 of the counterweight P also is pivotally supported to pivot in the same said vertical plane. Adjustable connecting means are provided to selectively vary the relative angular relationship between the boom 1 and the counterweight support 2; said connecting means comprises a linking device $3_1$, for instance a combination cables/pulleys, interconnecting the counterweight support 2 and the outer upper end or apex C of the pivoting intermediary structure OCR opposite to the boom 1. A second linking means $3_2$, also a combination cables/pulleys, interconnects the end S of the main support forming the horizontal swing axis O and the upper apex A of the boom ATR so as to selectively adjustably vary the span of the boom to thereby cover a variable surface for lifting loads suspended either to the extreme suspending point T at the distal end of the boom 1 or to an intermediary point $T_1$ on the lower girder RT of the boom. The pendular assembly comprised by the boom, the intermediary pivoting structure, the counterweight support and the linking means is suspended to the common general swing axis O formed by the support S mounted at the upper end of a double mast M.

The support S may be mounted on the mast M so as to be pivotable relative thereto around a vertical axis, as illustrated at 8. Alternatively, the whole assembly support S and mast M may be pivotably supported at the lower end of the mast M to pivot around said vertical axis. The hoisting assembly illustrated in FIG. 1 presents a wide range of span and may be convenient for suspending heavy loads for use in public works, in harbours or ship-building or nuclear plants. Convenient and usual controllable power means (not illustrated) are further provided for lifting or descending loads, other power means being provided to rotatingly drive the assembly around the vertical axis.

Figure 2:
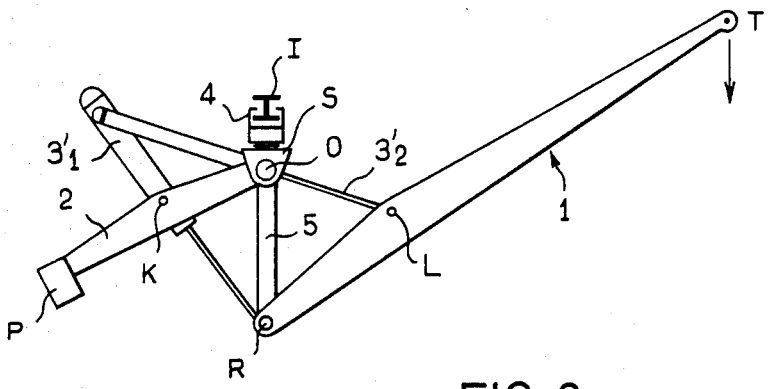
FIG. 2 illustrates a hanging hoisting assembly having a simplified boom for use in premises.

In the embodiment illustrated in FIG. 2, the boom 1 consists in a single unitary elongated structure which is hingedly connected at R by its inner end opposite to its load suspending end T to a double upright 5 is suspended at its upper end to the common general horizontal swing axis O formed by the support S. The double support 2 of the counterweight P is similarly hingedly connected by its inner end to said swing axis O. Adjustable connecting means between the counterweight support 2 and the boom 1 comprises a fist cylinder means $3'_1$ hingedly connected by its bottom end at R to the common hinge axis R of the double upright 5 and of the base portion of the boom 1, and at another separated point thereof to an intermediary point K of the counterweight support 2, while further extending upwardly between the two girders of the double support 2, as illustrated.

The proper angular position and, accordingly, the span of the boom 1, may be independently adjusted by means of a second cylinder means $3'_2$ hingedly connected to the common general swing axis O, the distal end of the rod of said cylinder means being hingedly connected to an upper intermediary point L of the boom 1, as illustrated. The support S is in turn suspended so as to be pivotable around a vertical axis under a carriage 4 displaceable along a rail I. Said hoisting assembly suspended below a monorail has variable load and span and is more particularly convenient for handling heavy or semi-heavy elements in workshops or warehouses.

Figure 3:
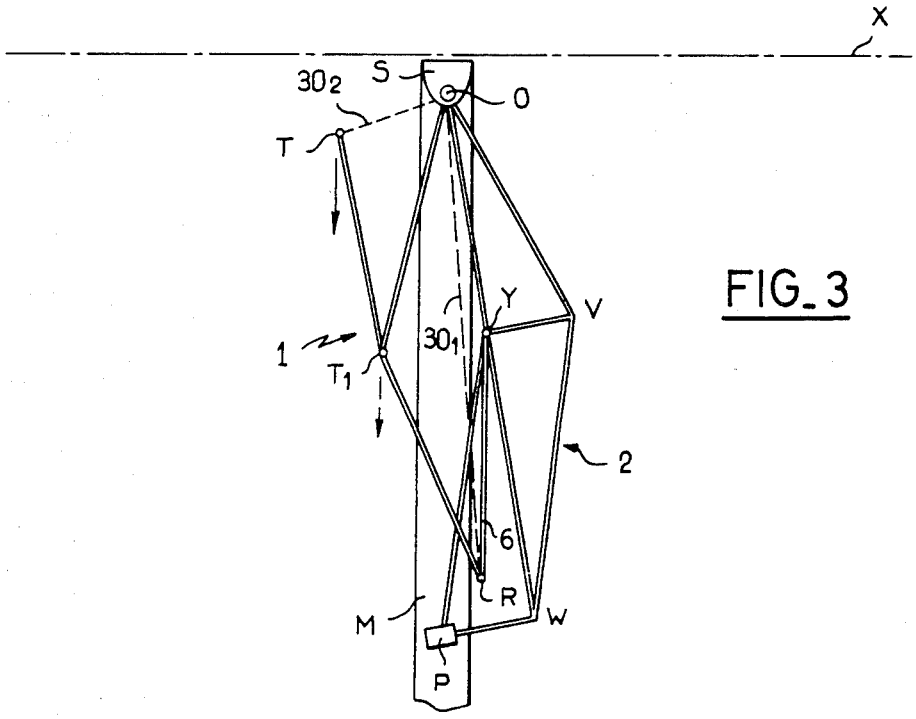
FIGS. 3 and 4 illustrate a hoisting assembly having a hanging superstructure according to the invention which may be operated below a ceiling plane.
Figure 4:
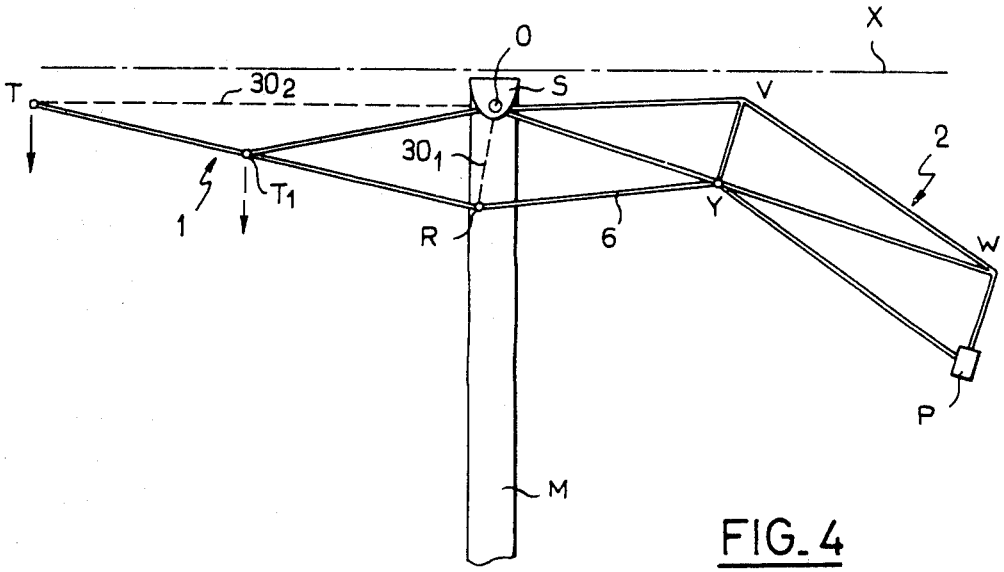

There is illustrated in FIGS. 3 and 4 a crane superstructure hung from a support S at the upper end of a single mast M and which may be operated with variable and wide span ranges while always remaining below a ceiling figurated by the plane X in dash and dotted line. The trussed boom structure 1 is comprised by the elements $TT_1$, $T_1R$ and $T_1S$ and comprises a base distortable sub-assembly $OT_1R$. The upper element $T_1O$ of said base sub-assembly has its inner end hingedly connected to the common general swing axis O and its lower element $T_1R$ has its inner end hingedly connected to the end of a central camber 6 (RY) the other end of which is hingedly connected at Y to an intermediary point of the support 2 of the counterweight P. The counterweight support 2 is comprised by the trussed structure OVWPY. The boom structure further comprises an end portion $T_1T$ hingedly connected at its inner end $T_1$ to the base sub-assembly $OT_1R$ of the boom structure. The boom and the camber are each divided into two identical parallel sub-assemblies and the hinge point $T_1$ interconnecting the boom base sub-assembly and the boom end portion may constitute a second intermediary point for suspending loads in addition to the extreme load suspending point T of the boom. Said extreme outer load suspending point T is connected to the support S by an adjustable connecting means $\mathbf{30}_2$ consisting in a combination cables/pulleys when the lower intermediary hinge point R is connected to the support S by a second adjustable connecting means $\mathbf{30}_1$, also advantageously a long run combination cables/pulleys. The hoisting assembly is illustrated in FIG. 3 in its gathered configuration corresponding to the minimum span, when it is illustrated in FIG. 4 in its fully expanded configuration corresponding to the maximum span of the boom 1. In both configurations, all the elements of the hoisting assembly remain below the horizontal plane X defined for instance by the ceiling of a house or of a building to which the support S may be further connected. As apparent from FIGS. 3 and 4, between said extreme configurations the inner connecting means 30 considerably varies in length substantially conversely to the variations in length of the outer or upper connecting means $\mathbf{30}_2$ interconnecting the support S and the extreme outer load suspending end T of the outer end portion $T_1T$ of the boom 1, the base sub-assembly of which is subject to considerable angular spreading between the gathered and extended configurations without however impeding the general pendular character of the whole assembly.

While the invention has been described with reference to particular embodiments, it is not confined to the details set forth but is intended to cover such modifications or changes as may come within the scope of the following claims.

What we claim is:

1. A hoisting assembly for hoisting loads, comprising:

a boom for suspending a load with said boom adapted to pivot in a vertical plane and with said boom extending in one direction, a counterweight support extending in an opposite direction from said boom and being pivotally mounted on a main horizontal swing axis so as to be pivotable in said vertical plane, an intermediate pivoting member pivotally connected to said boom whereby said boom is pivotable about an axis that is spaced from but in the same plane as said main horizontal swing axis, said intermediate pivoting member being pivotable substantially in said vertical plane and being pivotably connected to said main horizontal swing axis, a plurality of adjustable connecting means, one of said connecting means being connected to and extending between said boom and said main horizontal swing axis and another of said connecting means being connected to and extending between said intermediate pivoting member and said counterweight support, said one and said another of said connecting means being adjustable independently of one another whereby the angular position of said boom and said counterweight can be varied independently, said boom, said counterweight support, said intermediate pivoting member and said connecting means constituting a pendular assembly, idly swinging about said main horizontal swing axis formed by a support.

2. The hoisting assembly of claim 1 wherein said one connecting means is connected to said boom intermediate the ends of said boom.

3. A hoisting assembly for hoisting loads comprising:

a boom for suspending a load with said boom adapted to pivot in a vertical plane and with said boom extending in one direction relative to a main horizontal swing axis, a counterweight support extending in an opposite direction from said main horizontal swing axis and being pivotably mounted on said main horizontal swing axis so as to be pivotable in said vertical plane, a first adjustable connecting means connected to and extending between said main horizontal swing axis and said boom, said first adjustable connecting means comprising a first piston and cylinder means acting intermediate the ends of said boom and said main horizontal swing axis, said assembly including a second adjustable connecting means connected to and extending between said counterweight support and said boom, said second adjustable connecting means comprising a second piston and cylinder means, said boom having a first end and a second end spaced from said first end with said second end being remote from said main horizontal swing axis, said second piston and cylinder means being connected to said first end of said boom, said first piston and cylinder means being operable independently of said second piston and cylinder means whereby the position of said boom can be varied independently of said counterweight support.

* * * * *